US011453523B2

(12) United States Patent
Hutter

(10) Patent No.: US 11,453,523 B2
(45) Date of Patent: Sep. 27, 2022

(54) METHOD AND APPARATUS FOR LABELLING PRIMARY PACKAGINGS

(71) Applicant: KRONES AG, Neutraubling (DE)

(72) Inventor: Alban Hutter, Reit (DE)

(73) Assignee: KRONES AG, Neutraubling (DE)

( * ) Notice: Subject to any disclaimer, the term of this patent is extended or adjusted under 35 U.S.C. 154(b) by 343 days.

(21) Appl. No.: 16/304,861

(22) PCT Filed: Jun. 27, 2017

(86) PCT No.: PCT/EP2017/065872
§ 371 (c)(1),
(2) Date: Nov. 27, 2018

(87) PCT Pub. No.: WO2018/010953
PCT Pub. Date: Jan. 18, 2018

(65) Prior Publication Data

US 2020/0324930 A1 Oct. 15, 2020

(30) Foreign Application Priority Data

Jul. 12, 2016 (DE) ..... 10 2016 112 789.2

(51) Int. Cl.
*B65C 1/02* (2006.01)
*B65B 5/02* (2006.01)
(Continued)

(52) U.S. Cl.
CPC ..... *B65C 1/026* (2013.01); *B65B 5/024* (2013.01); *B65B 21/18* (2013.01); *B65B 43/126* (2013.01);
(Continued)

(58) Field of Classification Search
CPC ..... B65C 1/026; B65C 1/02; B65C 1/028; B65B 5/024; B65B 21/18; B65B 43/126; B65B 43/265; B65B 2220/16; B65D 43/14
(Continued)

(56) References Cited

U.S. PATENT DOCUMENTS 2,543,004 A 2/1951 Dewyer
2008/0073235 A1 3/2008 Harada et al.
(Continued)

FOREIGN PATENT DOCUMENTS

CN 1374916 A 10/2002
DE 3019506 A1 11/1981
(Continued)

OTHER PUBLICATIONS

German to English machine translations of WO 2013185954 A1.*
(Continued)

*Primary Examiner* — Anna K Kinsaul
*Assistant Examiner* — Luis G Del Valle
(74) *Attorney, Agent, or Firm* — Schmeiser, Olsen & Watts, LLP

(57) ABSTRACT

Provided is a method for labelling first packagings, including at least the following steps: transporting labels to a labelling zone, wherein an adhesive side of the labels is directed upward during the transport; removing the primary packagings to be labelled from a magazine device, wherein the packagings are provided in the magazine device as packaging blanks which are at least in sections flat, and are preferably removed individually from the magazine device; placing the primary packagings onto the labels and adhering the labels to the packagings, wherein the packagings are preferably pressed from above onto the labels; inserting the
(Continued)

first labelled packagings into secondary packagings; and introducing several containers into the primary and secondary packagings.

13 Claims, 5 Drawing Sheets

(51) Int. Cl.
*B65B 21/18* (2006.01)
*B65B 43/12* (2006.01)
*B65B 43/26* (2006.01)
*B65D 43/14* (2006.01)

(52) U.S. Cl.
CPC ..... *B65B 43/265* (2013.01); *B65B 2220/16* (2013.01); *B65D 43/14* (2013.01)

(58) Field of Classification Search
USPC ..... 53/135.1
See application file for complete search history.

(56) References Cited

U.S. PATENT DOCUMENTS

2010/0043355 A1* 2/2010 Duperray ..... B65B 65/003 53/147
2010/0264058 A1* 10/2010 Krause ..... B65D 5/5088 206/745
2015/0139772 A1* 5/2015 Rapp ..... B65B 59/003 53/381.1
2015/0143777 A1* 5/2015 Rapp ..... B65B 43/52 53/381.1
2015/0183535 A1* 7/2015 Vardakostas ..... B65B 5/045 53/72
2015/0329231 A1* 11/2015 Moncrief ..... B65B 59/003 53/543
2017/0217622 A1* 8/2017 Wolff ..... B65C 1/026

FOREIGN PATENT DOCUMENTS

| | | | |
|---|---|---|---|
| DE | 3830692 | A1 | 3/1990 |
| DE | 19817576 | C1 | 2/2000 |
| DE | 102009025824 | A1 | 11/2010 |
| DE | 102013106742 | A1 | 12/2014 |
| EP | 1410995 | A1 | 4/2004 |
| EP | 3012201 | A1 | 4/2016 |
| WO | WO2013185954 | A1 | 12/2013 |

OTHER PUBLICATIONS

German to English machine translations of EP 3012201 A1.*
Chinese Office Action dated May 7, 2020 for Application No. 201780033283.1.
International Search Report PCT/EP2017/065872.

* cited by examiner

METHOD AND APPARATUS FOR LABELLING PRIMARY PACKAGINGS

CROSS-REFERENCE TO RELATED APPLICATIONS

This application claims priority to PCT Application No. PCT/EP2017/065872, having a filing date of Jun. 27, 2017, based on German Application No. 10 2016 112 789.2, having a filing date of Jul. 12, 2016, the entire contents both of which are hereby incorporated by reference.

FIELD OF TECHNOLOGY

The following relates to a method and an apparatus for labelling primary packagings. In this case these primary packagings are packagings which accommodate a plurality of containers, in particular a plurality of beverage containers which are already filled. It is known from the known art that such primary packagings are delivered to the machine as flat packaging blanks or are present in the machine and are assembled and/or unfolded in a folding station or a folding or cartoning module to form so-called multipacks, for example baskets or outer packagings (wrap-around cartons). Usually several primary packagings are then inserted into secondary packagings, in particular transport and/or storage packagings, such as for example plastic boxes, folding packagings made of paperboard or cardboard, or outer packagings, and in turn several containers which are already filled and closed are inserted into the primary and secondary packagings. After the packaging module, individual printing of the secondary packagings takes place.

BACKGROUND

In this case the secondary packagings serve in particular in order to enable improved transport as well as improved storage of the containers. The containers are usually sold (to end customers) in the first packaging. Furthermore, it is also possible that the primary and/or the secondary packagings have so-called dividers, by which the containers or correspondingly the multipacks (primary packagings) can be accommodated individually and separately from one another.

However, a disadvantage of these known apparatus is that after the insertion into the transport packagings the individual multipacks (baskets or outer packagings) can no longer be imprinted individually, in particular since for this purpose the labelling devices are too large and the transport speed within the machine is too high. Accordingly, in the known art only imprinting or labelling of the transport packagings or the secondary packagings are carried out. A customer must therefore have a plurality of primary packagings with all different barcodes, country-specific imprints and the like in stock.

SUMMARY

An aspect relates to a method and an apparatus in which it is possible for individual labelling or imprinting to be applied already to the primary packagings, in particular before the containers are inserted into the packagings.

In a method according to embodiments of the invention for labelling primary packagings the labels are transported to a labelling zone, wherein an adhesive side of the labels is directed towards the primary packagings and in particular upwards during the transport. In a further step the primary packagings to be labelled are removed from a magazine device, wherein the packagings are provided in the magazine device as packaging blanks which are at least in sections flat, and are preferably removed individually from the magazine device. The primary packagings are preferably removed from a stack in which several flat packagings are arranged one above the other. The primary packagings are preferably removed from several magazine devices arranged adjacent to one another, wherein it is also conceivable that another type of primary packaging is arranged in each of the several magazine devices. As stated, the adhesive side of the label is preferably directed upwards, but other arrangements would also be possible, for instance lateral transport of the labels or attachment from the side.

The labels and advantageously the self-adhesive labels are preferably transferred from the label discharge station to a vacuum conveyor belt and transported in the direction of the labelling zone. The vacuum conveyor belt is preferably an endless circumferential belt. The vacuum conveyor belt preferably draws in the surface of the labels, which is not self-adhesive, and transports the labels in the direction of the labelling zone. The "self-adhesive forces" of the labels are greater than the suction force of the vacuum conveyor belt, so that it is ensured that the labels are adhered to the primary packagings and do not remain on the vacuum conveyor belt.

According to embodiments of the invention, in a subsequent step the primary packagings are placed onto the labels and the labels adhered to the packagings, wherein the packagings are preferably pressed from above onto the labels. Alternatively, it would also be possible to move the labels towards the packagings, for example to press them upwards. Advantageously the labels have a bonding and/or adhesive layer on their upper side, so that they adhere to the packagings due to the pressure of the packagings. After being placed onto the labels, the primary packagings are preferably inserted into secondary packagings, and/or, several objects such as containers are introduced into the primary and secondary packagings. However, it would also be conceivable that adhesive surfaces, onto which the label (which then may not be self-adhesive) is pressed, are present or formed on the packaging.

Advantageously six containers are arranged in the first packaging, so that so-called six-packs are preferably produced. The containers are advantageously beverage containers which are already filled and closed, in particular glass containers, plastic containers or cans. However, it is also conceivable that a plurality of containers, in particular more than six containers, are accommodated in a first packaging. Accordingly, the primary packagings are in particular so-called multi-packs. The embodiment can also be applied to objects other than containers and in particular to piece goods to be packaged. These are preferably piece goods of the same kind which are to be packaged together, such as for example care products or the like.

In this case the method according to embodiments of the invention and the apparatus according to embodiments of the invention have in particular the advantage that each multi-pack/each packaging can be separately and also individually labelled, decorated or provided with a barcode, and it is not only the transport packaging, in which several multipacks are arranged, which is labelled, as was usual hitherto in the known art. Accordingly, the customer also only has to keep one standardised carton in stock which is then printed with country-specific or product-dependent information, for example the shelf life of the product. Moreover, due to the pressing of the primary packagings onto the labels, before containers are introduced into the packagings, a comparatively simple procedure for labelling packagings is provided which, moreover, can also be integrated without great effort into any already existing plant.

Synchronised drives are advantageously provided, so that in particular the drive (shown schematically hereinafter in FIG. 3 as reference no. 36) of the label transport device and the drive (shown schematically hereinafter in FIG. 2 as reference no. 35) of the removal tool (shown hereinafter schematically in FIG. 2 as reference no. 34), by which the primary packagings are removed from the magazine device, are synchronised with one another. The movements of the transport device and of the removal tool are adapted to one another by these synchronised drives 35, 36, so that the labelling in particular can be controlled by means of these synchronised drives 35, 36.

The primary packagings are preferably placed as flat packaging blanks onto the labels, or after the removal from the magazine device the primary packagings are assembled in a folding station and only then the assembled primary packagings are placed onto the labels. In this case the assembly takes place, for example, with a stamp device which is applied to a later base region of the packaging whereby the side walls of the packaging are folded upwards. However, it is also conceivable that the assembly or unfolding of the packagings takes place in another manner already known from the known art, such as for example by means of suction and/or gripping devices which apply suction to or grip the flat packaging blanks and as a result pull them apart and assemble them.

Accordingly, it is proposed here to carry out the labelling of the primary packagings either before the assembly of the primary packagings, if these are still present as flat packaging blanks, or to place the primary packagings, which are already assembled by the folding station arranged upstream of the labelling zone, onto the labels.

An individual label and/or an individual barcode is advantageously applied to each primary packaging. In this case, for example, the label or the barcode can contain information concerning the filling date, the filling location, the best before date or a later storage or sales location. Preferably, however, an identical label and/or an identical barcode is applied to each primary packaging in the same packaging step. A difference between the labels is preferably only justified by product-specific and/or country-specific differences.

In a further advantageous method, the labels are individually and/or continuously transported to the labelling zone or transferred to the labelling zone. The highest possible processing rate of the packagings is achieved in particular by this individual and preferably continuous transport of the labels. In this case in a preferred method it would also be conceivable that two, three or more packagings are labelled simultaneously. However, it would also be conceivable that the transport of the labels takes place cyclically.

In a preferred method, in particular before the step of placing the packagings onto the labels, the position of the labels and/or of the packagings is detected by means of a position sensor or a camera and is preferably evaluated by an image processing unit. This determination of position advantageously already takes place before the labels are transported into the labelling zone, wherein for recognition of location or determination of position in particular a marking is applied to the labels. In this case it is conceivable that this marking is arranged on the top adhesive side of the label, but also that this marking is for example an image which is applied to the front face of the label and accordingly the position of the label is determined as a function of the position or the location of this image. In this case a corresponding camera or image recording device is preferably arranged laterally alongside a transport path of the labels. It would also be possible that the camera or image recording device is arranged above the transport path of the labels.

In the event of an incorrectly identified position, the label is advantageously aligned, and an aligning device is advantageously provided here for this purpose. In this case, however, it would preferably also be conceivable that in the event of an incorrect position of the label the plant is stopped, and the label is aligned or removed from the plant by an operator. In this case, within the context of this alignment the label can be displaced, in particular in at least two directions perpendicular to one another. Additionally, or alternatively it is also possible that the label is turned.

The labels are advantageously self-adhesive labels. However, it is preferably also conceivable that in the labelling zone a glue is applied to the label, in particular shortly before the packaging is pressed onto the label.

Furthermore, embodiments of the present invention is directed to an apparatus for labelling primary packagings, comprising at least one storage device on which at least one strip of labels with a plurality of labels is applied, at least one label transport device which transports the individual labels to a transfer zone, and a removal tool by means of which the primary packagings can be removed individually from a magazine device in which a plurality of primary packagings is stored.

According to embodiments of the invention the labels can be transported with an adhesive side directed towards the packagings and preferably upwards, and the removal tool brings the primary packagings onto the labels in order thus to arrange the labels on the packagings before (optionally) the primary packagings are inserted into secondary packagings. The packagings are advantageously pressed, in particular by the removal tool, onto the labels, so that the labels adhere with their adhesive side to the packagings. The labels are preferably transported in a rectilinear direction before they are attached to the packagings. Advantageously, the packagings are also transported at least in sections in a rectilinear direction. A transport direction along which the labels are transported is preferably perpendicular to a transport direction along which the packagings are transported.

In a further advantageous embodiment, the apparatus has a separating device which separates the containers arranged on the strip of labels. This separating device is advantageously arranged before the transfer zone. However, it would also be conceivable that the separating device is arranged shortly after the transfer zone and the labels are only separated after the transfer zone. In particular the separating device is a blade, a laser, shears or the like. The above-mentioned storage device is preferably a storage roll, from which the strip of labels and therefore the labels are unrolled In a preferred embodiment the storage device has at least two such storage rolls. In this case it is conceivable that they are preferably unrolled simultaneously, so that the number of packagings labelled in a specific time can be increased. The number of label transport devices present preferably corresponds to the number of storage rolls, so that they can also be transported simultaneously on separate conveyor belts to the labelling zone. Furthermore, it is also conceivable that a plurality of storage rolls is arranged in the storage device, so that in particular in the event of a roll change there is no need for a machine stoppage.

In a further advantageous embodiment, it would also be conceivable that the removal tool removes the packagings from the magazine and transfers them to a packaging transport device by which the packagings are transported to the machine. Advantageously, the label transport device (and/or the packaging transport device) is a vacuum conveyor, a transport belt or the like. It would also be possible that several labels are attached to a packaging.

The label is preferably a self-adhesive label, so that without further provisions the label adheres by itself on the first packaging as soon as the removal tool presses the packaging onto the label. Advantageously, however, it would also be conceivable that within the machine glue is applied to the labels, in particular after the transfer zone and/or shortly before the packaging is pressed onto the label.

Advantageously the primary packagings are stored as at least sectionally flat packaging blanks in the magazine device. The primary packagings in the magazine device preferably form a stack of a plurality of packagings arranged one above the other. The apparatus preferably comprises several such magazine devices, which in particular are arranged adjacent to one another, wherein with several magazine devices it is also conceivable to arrange different primary packagings in the magazine device.

In a further advantageous apparatus, a folding station, which assembles or unfolds the flat blanks to form multipacks after labelling, is arranged downstream of the apparatus for labelling primary packagings, or the folding station is arranged upstream of the apparatus for labelling primary packagings, so that the primary packagings are assembled or unfolded to form multipacks before the labelling.

Accordingly, the primary packagings can advantageously be placed as flat packaging blanks or as assembled packagings onto the labels. When the already assembled primary packagings are placed onto the labels it would preferably also be conceivable that the assembled primary packagings are also placed onto the labels by the assembling tool.

The removal tool is preferably a robot, a gripping tool or the like. In this case the robot and/or the gripping tool preferably has one or more gripping arms, at the end of which a vacuum gripper is arranged, by means of which the primary packagings can be removed from the magazine device and/or from the folding station.

Furthermore, the apparatus advantageously has a pressing device which presses the primary packagings onto the labels perpendicularly to the adhesive surface of the label. The pressing device can preferably be a further robot or a further gripping tool with one or more gripping arms, on the end of which a vacuum gripper is preferably arranged. The pressing device is preferably arranged in the removal tool. Accordingly, the removal tool is advantageously configured in such a way that it is suitable for removing the primary packagings from the magazine device and/or the folding station and pressing them onto the labels.

BRIEF DESCRIPTION

Some of the embodiments will be described in detail, with references to the following Figures, wherein like designations denote like members, wherein.

DETAILED DESCRIPTION

Figure 1:
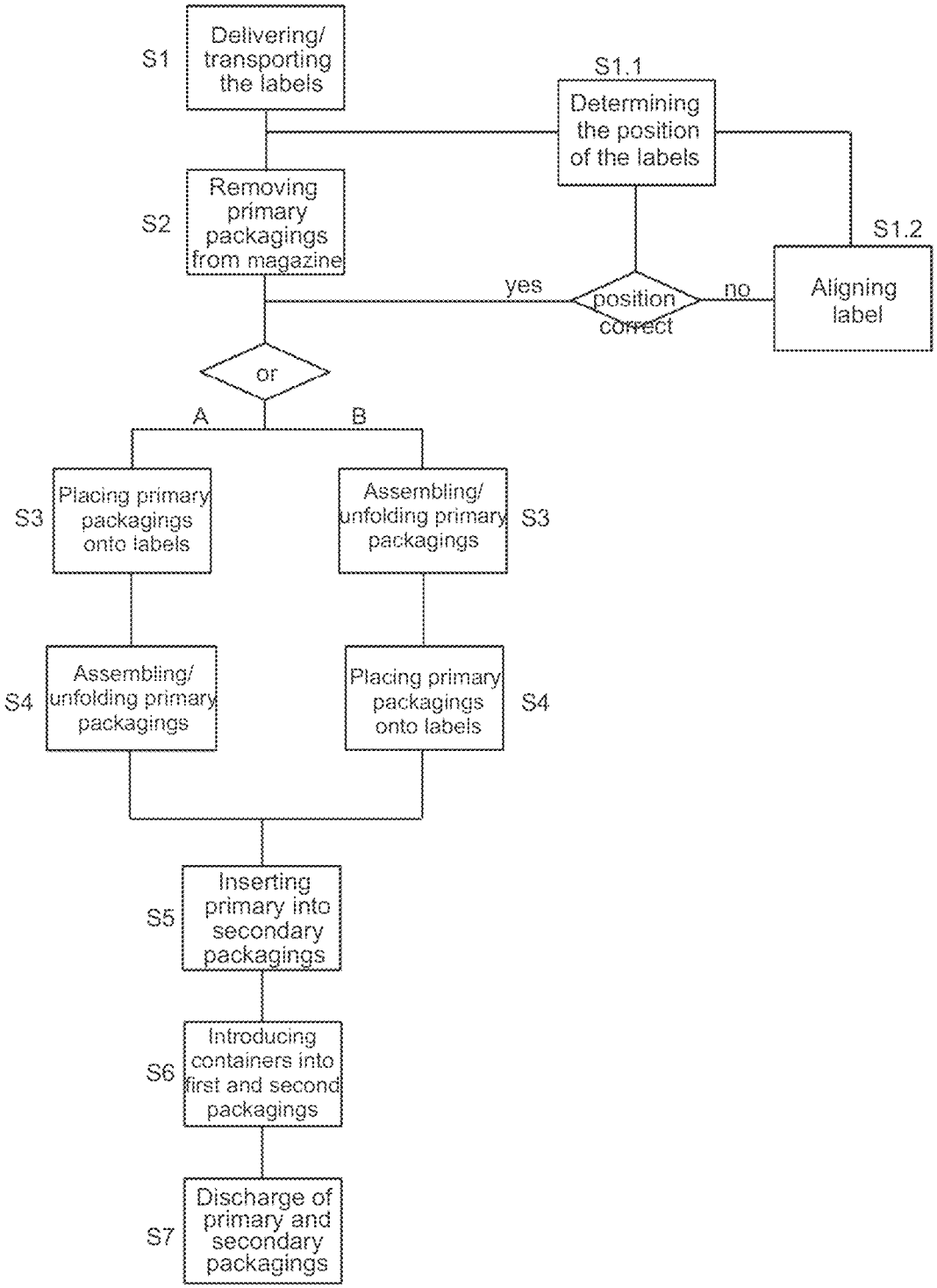
FIG. 1 shows a flow diagram of a method.

FIG. 1 shows a flow diagram of an apparatus according to embodiments of the invention. In a first step S1 the labels are fed to a labelling zone or are transported to a labelling zone, wherein the labels are advantageously transported with an adhesive side upwards. In a second step S2 the primary packagings are removed from a magazine device. In this case it would also be conceivable that the steps S1 and S2 are carried out simultaneously, or at least at times overlap. Subsequently, in a first variant A, in a third step S3 the primary packagings are placed onto the labels, preferably being pressed onto the labels from above, and in a further step S4 the primary packagings are unfolded and/or assembled to form multipacks. This can be carried out in particular by methods which are already known from the known art.

As can be seen from the flow diagram, however, it is also possible that the method steps S3 and S4 are carried out in reverse order and accordingly the primary packagings are initially unfolded and/or assembled and are then placed in the unfolded state onto the labels.

In a method step S5 the first packs are inserted into secondary packagings, wherein, as already described above, the primary packagings are so-called baskets which hold several containers and the secondary packagings are packagings which enable improved storage and improved transport of the containers. Lastly, in a following step S6 containers which are already filled and closed are introduced into the primary and secondary packagings, wherein the containers are in particular glass containers, plastic containers or cans and in step S7 the primary and secondary packagings with the containers arranged therein are discharged or removed.

Optionally, in an advantageous method further method steps S1.1 and S1.2 can also be carried out. In this case, after the delivery of the labels (S1) a determination of the position of the labels is carried out in order to ensure that they are attached to the packagings in a required location. In this case this determination of the position can preferably take place by means of a position sensor or a camera and can be evaluated with an image processing unit. If the label is located in a correct position, the method can continue with step S3. If this is not the case the labels are aligned in step S1.2. Then the position of the labels is checked again (S1.1). The alignment of the labels advantageously takes place by means of an aligning device. However, it would also be conceivable that an operating display shows which label has an incorrect position and this label is aligned by an operator. In this case, in variant B of the flow diagram it is also conceivable that this determination of the position is only carried out after the assembling of the primary packagings.

In this case, the method sequence described above merely constitutes an example, so that not all of the steps shown necessarily have to be carried out. Also, it is not necessary to carry out the method in the described sequence.

Figure 2:
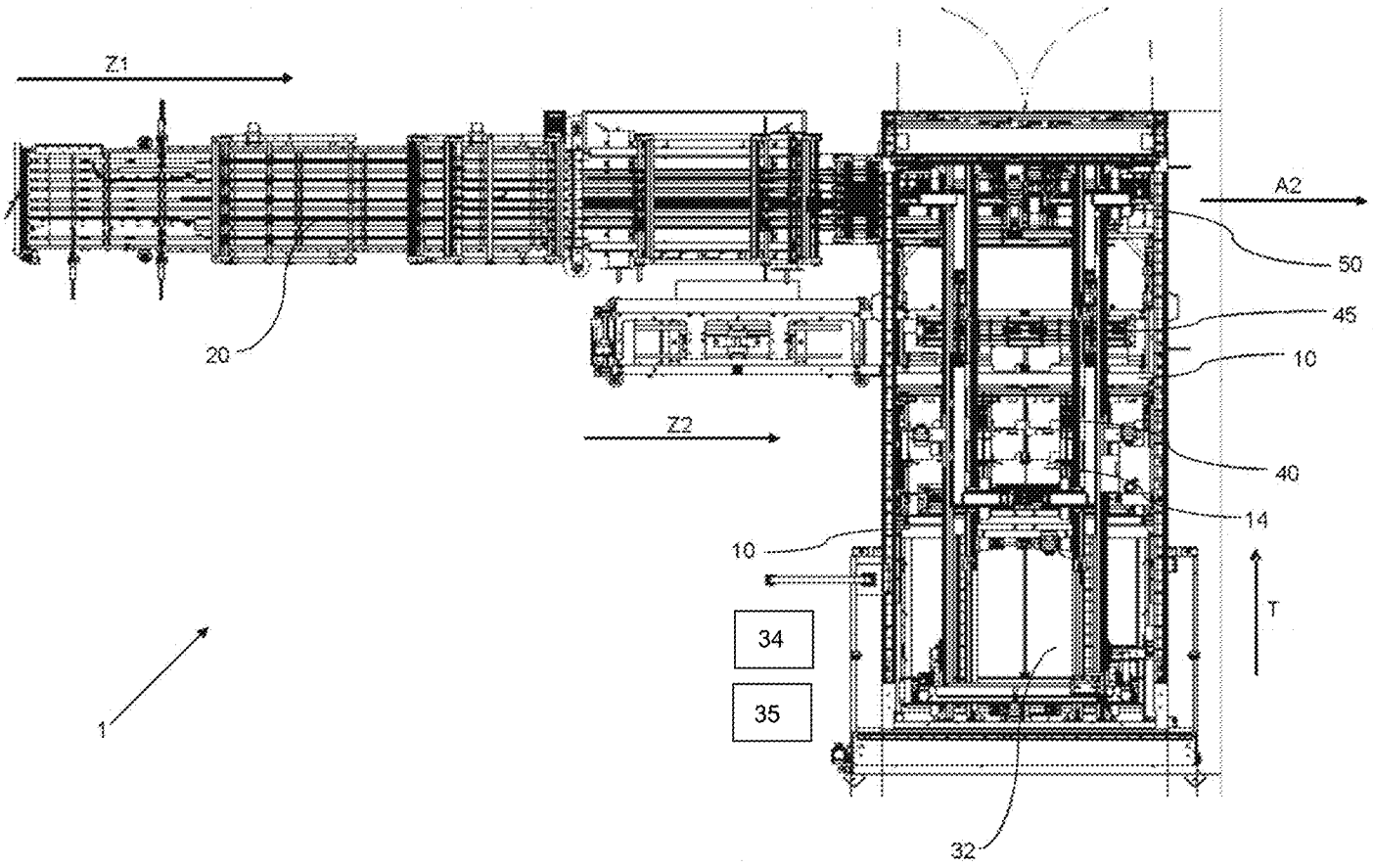
FIG. 2 shows a representation of an entire apparatus for labelling primary packagings and for packaging containers.

FIG. 2 shows a representation of an entire apparatus for labelling primary packagings 14 and for packaging containers. In this case the arrow Z1 represents the transport direction and the infeed of the containers. The containers are advantageously delivered to the apparatus 1 on one transport device and preferably on several transport devices 20 within one and preferably within several streams of articles arranged adjacent to one another. The transport devices 20 are advantageously transport belts, belt conveyors, roller conveyors or the like. The containers are preferably arranged close together on the transport devices, preferred spaced apart from one another and particularly preferably already grouped into a predetermined number of containers. The containers are preferably transported upright to the apparatus 1 or are delivered upright to the apparatus 1.

The infeed of the secondary packagings is represented by the arrow Z2 and the transport direction of the primary packagings is represented by the arrow T. These further conveying means for delivery of the secondary packagings and the primary packagings are likewise preferably transport belts, belt conveyors, roller conveyors or the like. In this case it is evident according to FIG. 2 that the transport direction of the infeed of the containers Z1 advantageously extends perpendicularly or orthogonally with respect to the transport direction of the primary packagings T. Furthermore, it is evident that the infeed of the containers Z1 advantageously takes place parallel to the infeed of the secondary packagings Z2.

The two positions provided with the reference numeral 10 constitute possibilities as to where the labelling zone can be arranged. The primary packagings 14 are advantageously removed by means of a removal tool (not shown) from a magazine device 32. Subsequently, in a first preferred variant, inside the labelling zone 10 the primary packagings 14 are placed onto the labels, in particular pressed onto the labels, and are subsequently assembled or unfolded in a folding station 40 to form multipacks. However, in a second advantageous variant it would also be conceivable that after the removal from the magazine device 32 the primary packagings 14 are transferred into the folding station 40 and, only after assembly, are placed onto the labels in the subsequent labelling zone 10.

After the primary packagings 14 have been assembled and labelled, they are inserted into second packagings (not shown) in an insertion region 45 arranged downstream of the folding station 40 and the labelling zone 10. Furthermore, the reference numeral 50 designates the container packaging station in which the containers are introduced into the primary and secondary packagings.

The removal of the containers from the stream of articles and the insertion of the containers into the primary and secondary packagings advantageously takes place by means of one or more manipulators. This manipulator is preferably a multi-axis robot, which preferably has several grippers and is preferably horizontally and vertically movable.

The further arrow A2 shows the discharge of the primary and secondary packagings with the containers arranged therein. This discharge is preferably again a transport belt, a conveyor belt, a roller conveyor or the like. The infeed of the containers Z1 and the discharge of the primary and secondary packagings A2 takes place advantageously in the same transport direction.

Figure 3:
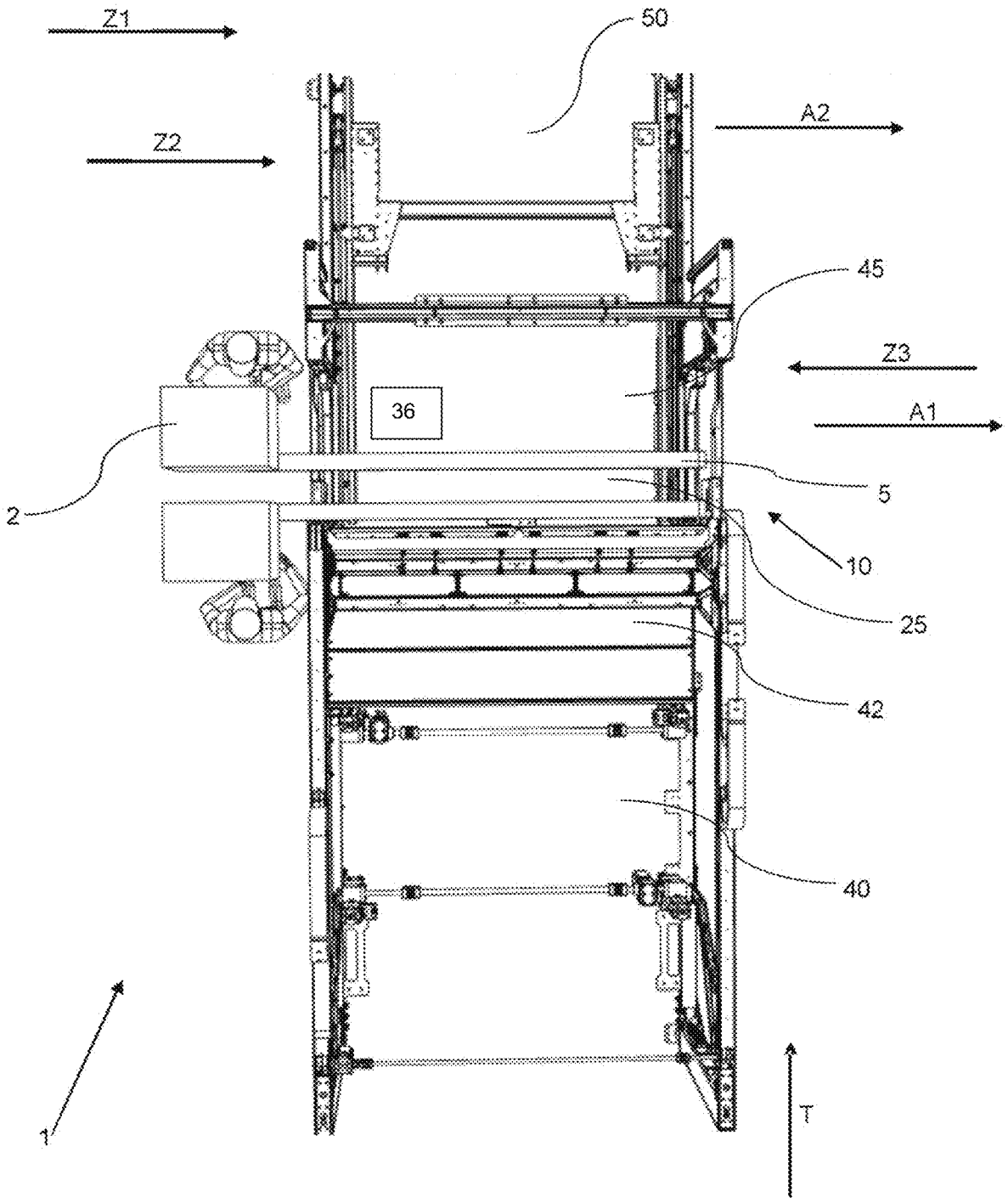
FIG. 3 shows a plan view of an apparatus for labelling primary packagings.

FIG. 3 shows a plan view of a first apparatus 1 according to embodiments of the invention for labelling primary packagings. The reference numeral 40 here again designates the folding station and the reference numeral 10 designates the labelling zone, so that FIG. 3 shows the embodiment in which the primary packagings are initially assembled or unfolded and subsequently are placed onto the labels. As already described above, however, it would also be conceivable that the primary packagings are initially labelled within the labelling zone 10 and subsequently the already labelled primary packagings are assembled to form multipacks.

The labelling zone 10 here has two storage devices 2, inside each of which at least one label roll is arranged. The reference numeral 5 designates a label transport device which is preferably designed as a vacuum conveyor and transports the labels from the storage device 2 to a transfer zone 25, at which the primary packagings are placed onto the labels. At least two label transport devices 5 are preferably present in the apparatus 1. The primary packagings are also placed onto the labels by an assembling tool (not shown) which assembles the primary packagings.

Furthermore, as already shown in FIG. 2, in the insertion zone 45 the primary packagings are inserted into the secondary packagings and in the container packaging station 50 containers are introduced into the primary and secondary packagings.

Here again, the arrows Z1 and Z2 indicate the delivery of the containers and the secondary packagings, as has likewise already been explained in greater detail in FIG. 2, and the arrow A2 indicates the discharge of the primary and secondary packagings with the containers arranged therein, and the arrow T indicates the transport direction of the primary packagings. In this case it would also be conceivable that the delivery of the secondary packagings takes place at the location designated by the arrow Z3. Accordingly, the transport direction of the secondary packagings Z2, Z3 is advantageously either the same as the transport direction of the delivery of the containers Z1 or opposed to the transport direction of the delivery of the containers Z1.

As can be seen from FIG. 3, it would also be conceivable to arrange the discharge of the secondary packagings at the location designated by the arrow A1. In this case, furthermore, it would be conceivable that the insertion zone 45 and the container packaging station 50 overlap and accordingly the insertion of the primary packagings into the secondary packagings and the insertion of the containers into the first and secondary packagings takes place at a common area.

Figure 4:
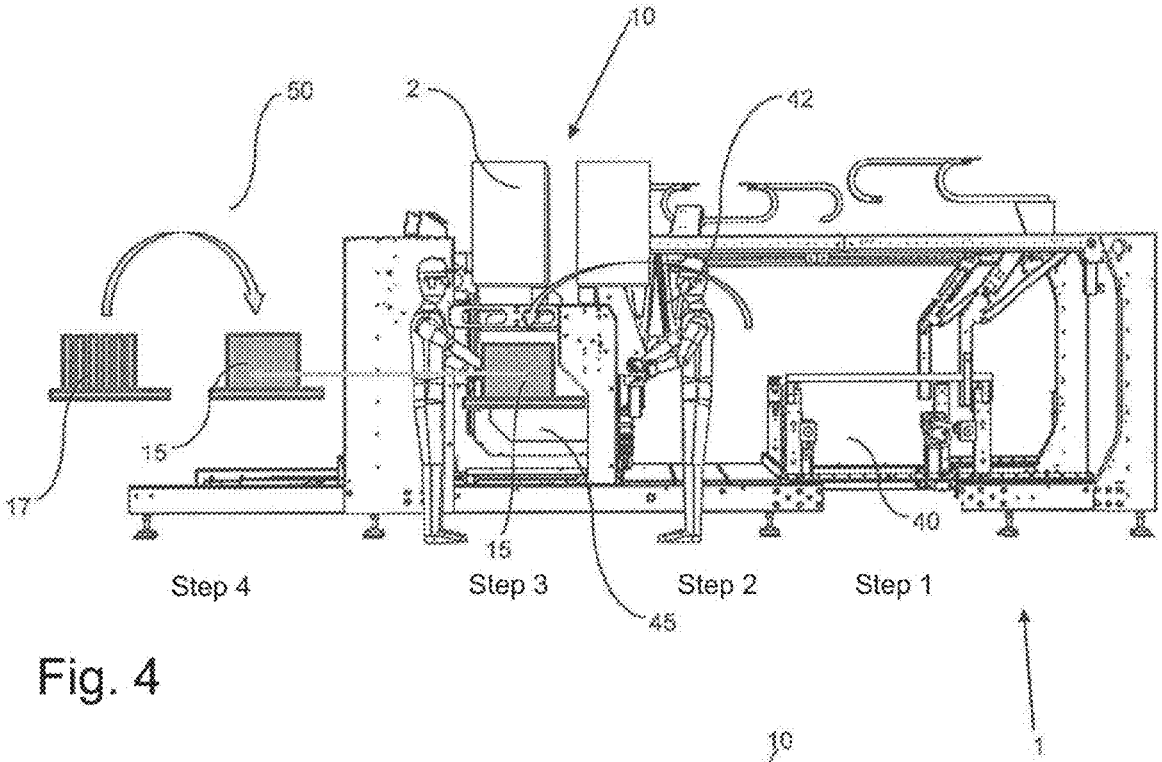
FIG. 4 shows a side view of the apparatus illustrated in FIG. 3.

FIG. 4 shows a side view of the first apparatus according to embodiments of the invention which is illustrated in FIG. 3. At the location designated by step 1, as already described above, a folding station is arranged which assembles and/or unfolds the primary packagings. The reference numeral 42 here designates a removal zone, at which the primary packagings are removed by a removal tool (not shown), for example a robot, a gripping tool or the like, from the folding station 40, and in the step 2 they are in particular pressed onto the labels. Accordingly, in this embodiment of the apparatus 1 at least two removal tools arranged, wherein the primary packagings are removed from the magazine device (not shown here) by one removal tool and are transferred to the folding station, and by another removal tool the assembled primary packagings are removed from the folding station and placed onto the labels. However, it would also be conceivable that the primary packagings are placed onto the labels by the assembling tool.

In step 3 the insertion of the primary packagings into secondary packagings 15 in the insertion zone 45 is illustrated schematically, and in step 4 the introduction of the containers 17 into the primary and secondary packagings inside the container packaging station 50 is illustrated schematically.

Figure 5:
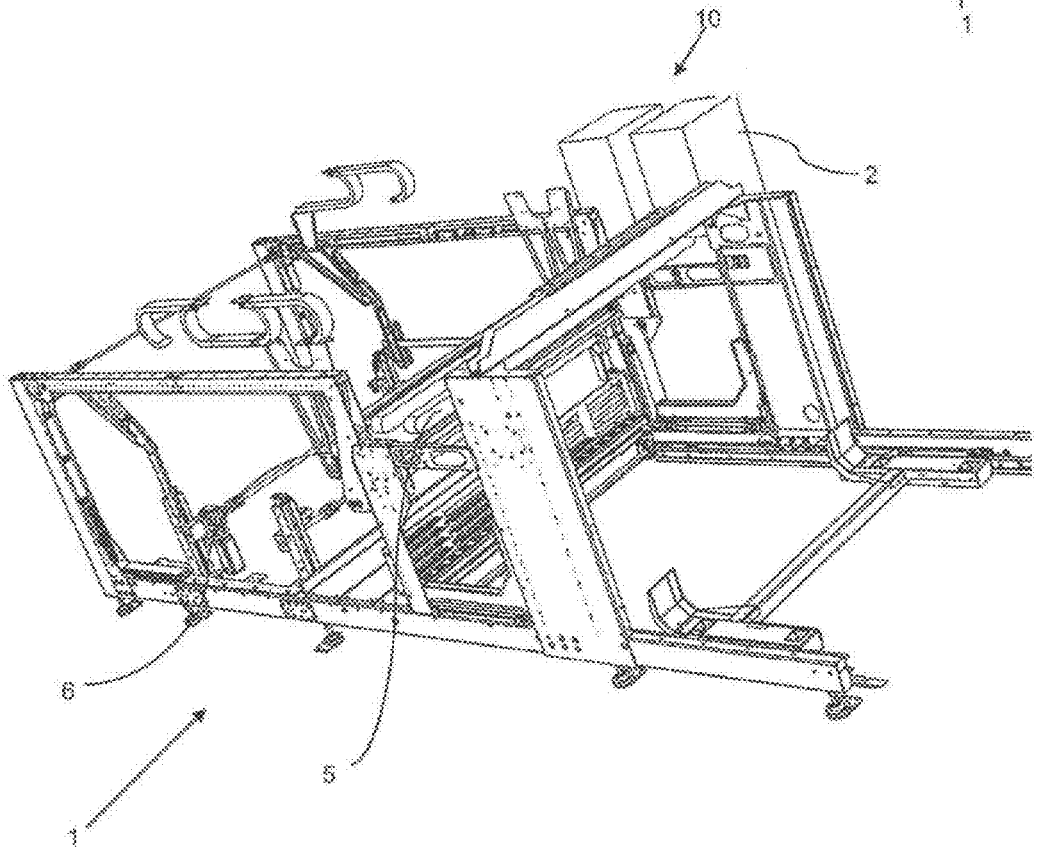
FIG. 5 shows a three-dimensional representation of the apparatus illustrated in FIGS. 3 and 4.

FIG. 5 furthermore shows a three-dimensional representation of the apparatus 1 illustrated in FIGS. 3 and 4. In this case, here again, the labelling zone 10 is shown, which has at least one storage device 2 and at least one label transport device 5 which is preferably designed as a vacuum conveyor. The reference numeral 6 designates a manipulator, although here for reasons of clarity the removal tool on the manipulator is not illustrated.

Figure 6:
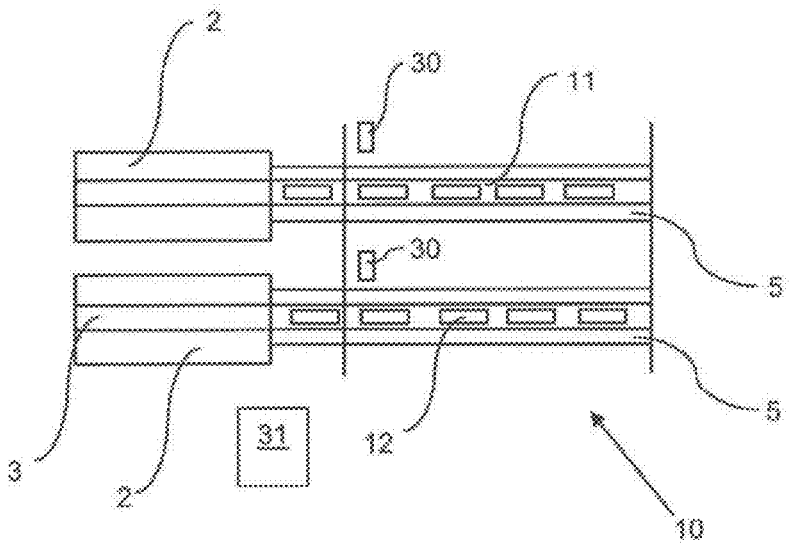
FIG. 6 shows a plan view of the labelling zone of the apparatus.

FIG. 6 shows a schematic representation of a plan view of the labelling zone 10 of the apparatus 1 according to embodiments of the invention. In this case at least one storage device 2 is associated with the labelling zone 10, in which at least one storage roll 3 is arranged, from which a strip of labels 11 is unrolled. In the embodiment illustrated here two storage devices 2 are illustrated, which are arranged alongside one another or one behind the other. Furthermore, it can be seen from illustration in FIG. 6 that here two parallel label transport devices 5 are provided.

Furthermore, a separate drive 36 is associated with each label transport device 5, for example, as shown in FIG. 3. However, it would also be conceivable that a drive for several label transport devices is provided. The drive is in particular an electrical, pneumatic or hydraulic drive. Furthermore, a position sensor 30 or a camera 30, by means of which the position of the labels is determined, is associated with each label transport device. The reference numeral 31 designates schematically an image processing unit which evaluates the information obtained from the position sensor 30 or the camera 30.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

LIST OF REFERENCES

1 apparatus
2 storage device
3 storage roll
5 label transport device
6 manipulator
10 labelling zone
11 strip of labels
12 labels
14 primary packaging
15 secondary packaging
17 container
20 transport devices
25 transfer zone
30 position sensor, camera
31 image processing unit
32 magazine device
40 folding station
42 removal zone
45 insertion zone
50 container packaging station
Z1 infeed of the containers
Z2 infeed of the secondary packagings
Z3 infeed of the secondary packagings
T transport direction of the primary packagings
A1 discharge of the primary and secondary packagings
A2 discharge of the primary and secondary packagings

The invention claimed is:

1. A method for labelling primary packagings, comprising:

transporting labels to a labelling zone, wherein an adhesive side of the labels is directed upward during the transport;

removing the primary packagings, which are multipacks, to be labelled from a magazine device, wherein the packagings are provided in the magazine device as packaging blanks which are at least in flat sections, and are individually removeable from the magazine device;

placing the primary packagings onto the labels and adhering the labels to the primary packagings, wherein the primary packagings are pressed from above onto the labels;

inserting a plurality of labelled primary packagings into secondary packagings, which are at least one of transport packagings and storage packagings configured to enable storage and transport of several filled and closed containers; and introducing the several filled and closed containers into the plurality of labelled primary packagings which are inserted in the secondary packagings.

2. The method according to claim 1, wherein the primary packagings are placed as flat packaging blanks onto the labels, or after the removal from the magazine device the primary packagings are assembled in a folding station and the assembled primary packagings are placed onto the labels.

3. The method according to claim 1, wherein the label is an individual label and/or an individual barcode which is applied to the primary packagings.

4. The method according to claim 1, wherein the labels are transported individually and/or continuously to the labelling zone.

5. The method according to claim 1, wherein the position of the labels is detected by a position sensor or a camera and is evaluated by an image processing unit.

6. The method according to claim 1, wherein the label is a self-adhesive label.

7. The method according to claim 1, wherein a drive of a label transport device and a drive of a removal tool by which the primary packagings are removed from the magazine are synchronized with one another.

8. The method according to claim 1, wherein the primary packagings are packagings which accommodate a plurality of beverage containers which are already filled.

9. The method according to claim 1, wherein several multipacks are arranged in one transport packaging.

10. The method according to claim 1, wherein before the step of placing the primary packagings onto the labels and/or of the primary packagings is detected by a position sensor or a camera and is evaluated by an image processing unit.

11. The method according to claim 10, wherein a marking is applied to the labels for recognition of location or determination of position.

12. The method according to claim 1, wherein a transport direction of the infeed of the containers extends perpendicularly or orthogonally with respect to a transport direction of the primary packagings and the infeed of the containers is parallel to the infeed of the secondary packagings.

13. The method according to claim 1, wherein a transport direction of the secondary packagings is the same as the transport direction of the delivery of the containers or is opposed to the transport direction of the delivery of the containers.

* * * * *